US009903126B2

(12) United States Patent
Rowsome

(10) Patent No.: US 9,903,126 B2
(45) Date of Patent: Feb. 27, 2018

(54) MOVABLE SCAFFOLD

(71) Applicant: Robert L. Rowsome, Innisfil (CA)

(72) Inventor: Robert L. Rowsome, Innisfil (CA)

( * ) Notice: Subject to any disclaimer, the term of this patent is extended or adjusted under 35 U.S.C. 154(b) by 0 days.

(21) Appl. No.: 15/180,344

(22) Filed: Jun. 13, 2016

(65) Prior Publication Data

US 2017/0356198 A1 Dec. 14, 2017

(51) Int. Cl.
*E04G 1/24* (2006.01)
*E04G 1/22* (2006.01)

(52) U.S. Cl.
CPC ..... *E04G 1/24* (2013.01); *E04G 1/22* (2013.01); *E04G 2001/242* (2013.01)

(58) Field of Classification Search
CPC ..... E04G 1/24
See application file for complete search history.

(56) References Cited

U.S. PATENT DOCUMENTS 2,014,085 A * 9/1935 Kroll ..... B62B 9/08 188/20
3,502,172 A * 3/1970 Ismond ..... B60P 3/14 180/440
3,731,758 A 5/1973 Hibma
3,865,203 A 2/1975 Hibma
3,930,548 A 1/1976 Wallraff
4,088,202 A 5/1978 Costello
4,275,797 A 6/1981 Johnson
4,475,611 A 10/1984 Fisher
4,620,608 A * 11/1986 Gilbreath ..... E04G 1/24 182/127
4,662,476 A 5/1987 Ross
4,967,733 A * 11/1990 Rousseau ..... B66F 11/04 182/13
4,967,766 A * 11/1990 Bradshaw ..... A61N 1/0573 600/377
5,076,448 A * 12/1991 Ballard ..... B66C 23/48 212/261
6,039,148 A 3/2000 Riegel
6,076,621 A 6/2000 Horn
6,533,067 B2 3/2003 Chick
6,540,039 B1 4/2003 Yu et al.
6,786,299 B2 9/2004 Bennett
6,880,672 B2 * 4/2005 Imberi ..... E04G 1/24 182/13
6,883,641 B2 4/2005 Julien
8,434,592 B1 5/2013 Young
(Continued)

*Primary Examiner* — Alvin Chin-Shue
(74) *Attorney, Agent, or Firm* — Manelli Selter PLLC; Edward J. Stemberger

(57) ABSTRACT

A movable scaffolding base for transporting an assembled scaffold along a ground surface comprising a frame, having a front, and a rear, and defining a horizontal plane when the assembled scaffold is attached thereto a drive motor, a steering actuator, a pair of rear wheels attached at the rear and driven by the drive motor to drive the frame, a pair of front wheels attached at the front which are rotated to effect steering by action of the steering actuator, a control system for controlling the drive motor and the steering actuator, a set of scaffold support posts attached to the frame that removably attach to vertical members of the assembled scaffold, and one or more outriggers, extending outwards from a first side of the frame to prevent rotation of the horizontal plane towards the side.

10 Claims, 5 Drawing Sheets

(56) References Cited

U.S. PATENT DOCUMENTS

| | | | | |
|---|---|---|---|---|
| 8,449,424 | B2 | 5/2013 | Schoon | |
| 2001/0045718 | A1* | 11/2001 | Boirum | B25H 3/02 280/47.26 |
| 2002/0130487 | A1* | 9/2002 | Berkmann | B62H 1/04 280/303 |
| 2004/0222605 | A1* | 11/2004 | Sterns | B62B 3/027 280/47.34 |
| 2005/0030593 | A1* | 2/2005 | Orozco-Abundis | H04N 1/00562 358/474 |
| 2011/0266766 | A1* | 11/2011 | Huang-Tsai | B60R 3/00 280/169 |
| 2011/0297465 | A1 | 12/2011 | Huntley et al. | |
| 2014/0311825 | A1 | 10/2014 | Watson et al. | |
| 2015/0083508 | A1 | 3/2015 | Bluenthmann et al. | |

* cited by examiner

MOVABLE SCAFFOLD

FIELD

The invention relates generally to scaffolding, and more particularly to movable scaffolding including movable scaffolding bases.

BACKGROUND

Scaffolds allow workers to reach, and work, at heights outside of their normal reach. Scaffolding has various standard dimensions, materials, and approaches. Scaffolds, and scaffolding as interchangeably used herein, is typically assembled and worked on, and is then disassembled to move to a new location.

More recently, approaches to movable scaffolding have been considered. Some of such approaches include motorized movement of scaffolds, for example.

However such movable scaffolds suffer from several deficiencies that make them less safe and less practical. It is therefore desirable to manufacture and use a movable scaffold that addresses some of these deficiencies.

SUMMARY

In one aspect the invention provides a movable scaffolding base for moving an assembled scaffold along a ground surface comprising:

a frame extending along an elongate axis and adapted for supporting the assembled scaffold;
a drive motor;
a plurality of wheels disposed on the frame and driven by the drive motor;
a control system for controlling the drive motor;
a mounting system disposed on the frame for mounting the assembled scaffold,
at least one outrigger, extending outwards from the frame.

In another aspect the invention provides a movable scaffold comprising a movable scaffolding base and a scaffold that is adapted to be removably supported on said base, said movable scaffolding base comprising:

a frame extending along an elongate axis and adapted for supporting the scaffold;
a drive motor;
a plurality of wheels disposed on the frame and driven by the drive motor;
a control system for controlling the drive motor;
a mounting system disposed on the frame for mounting the assembled scaffold,
at least one outrigger, extending outwards from the frame.

BRIEF DESCRIPTION OF THE DRAWINGS

Embodiments will now be described, by way of example only, with reference to the attached Figures, wherein.

DETAILED DESCRIPTION OF THE EMBODIMENTS

A movable scaffold, in accordance with the present invention, comprises a movable scaffolding base 10 that is adapted to support a conventional or modified scaffold 50. Generally, the structures and methods as herein described permit a conventional or modified scaffold 50, or portions thereof, to be removably attached to a movable scaffolding base 10. The movable scaffolding base 10 may be controlled by a worker standing on scaffolding 50 or located nearby. The movable scaffolding base 10 can be stored, as described herein, and may be used to return scaffolding 50 to where it is stored when removed from movable scaffolding base 10.

The figures that follow will illustrate the movable scaffold, the various required and/or optional elements, and the manners by which such movable scaffold and additional elements may be used in practice.

Figure 1:
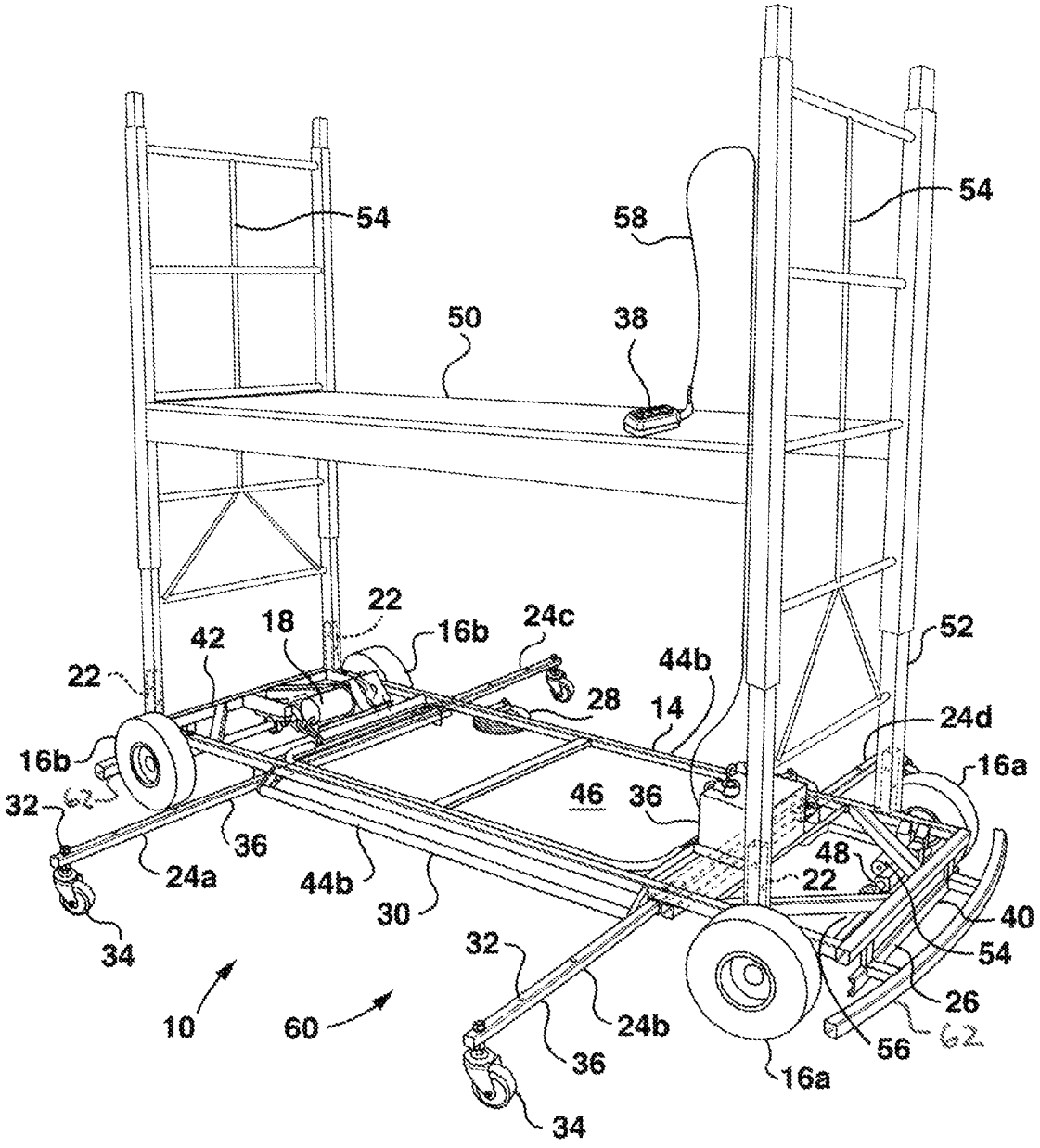
FIG. 1 is a perspective view of a movable scaffold, according to an embodiment of the invention.

Referring now to FIG. 1, there is a view of the movable scaffolding base 10 on surface 60 (which may be any surface or combination of surfaces, preferably somewhat level, firm and smooth) and a scaffold 50 attached thereto.

As will be described in more detail below, the movable scaffolding base 10 comprises a frame 14 having a front 40, a rear 42 and two sides 44*a*/44*b* that define horizontal plane 46. Movable scaffold base 10 further comprises front wheels 16*a*, rear wheels 16*b*, storage wheels 28, power source 36, drive motor 18, steering actuator 48 and outriggers 24*a-d*. Outriggers 24*a-d* further comprise outrigger extending members 36, extending member holes or connectors 32*a*/32*b* and outrigger wheels 34. Movable scaffold base 10 further comprises tip guards 26 and bumpers 62 that extend across front 40 and rear 42 sufficiently to cover wheels 16*a* and 16*b*.

Various functional and structural aspects of movable scaffolding base 10 will be described below, with respect to the figures herein.

Scaffold and Connection to Movable Scaffolding Base

Scaffold 50 may be substantially any scaffold or portion thereof (referred to herein interchangeably as 'scaffolding'). Scaffold may be a conventional scaffold such as, but not limited to, works with tube and coupler (fitting) components, prefabricated modular system scaffold components, H-frame/facade modular system scaffolds, and timber scaffolds—provided that scaffold 50 is able to be removably attached or received by movable scaffolding base 10. Scaffold 50 may also be a modified scaffold as shown in FIG. 1 and described further below.

Figure 5:
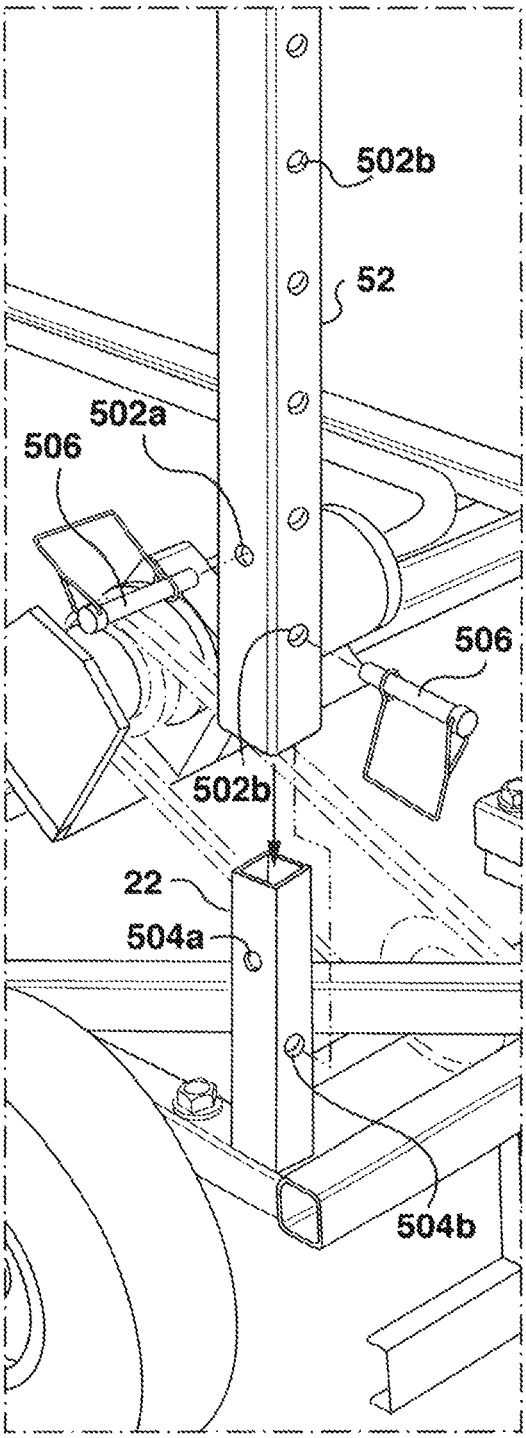
FIG. 5 is an enlarged exploded perspective view of a portion of the base for the movable scaffold of FIG. 1 and its connection with the remainder of the scaffold, according to an embodiment of the invention.

Scaffold 50 may have one or more vertical scaffold members 52 that may be removably attached to scaffold support posts 22, as shown in FIG. 5. For example, and as shown in FIG. 5, scaffold support posts 22 and vertical scaffold member 52 may be tubes (of substantially any shape, such as square or round) such that scaffold support posts 22 ("insertion tube" as depicted in FIG. 5) fits within, is enveloped by, or telescopically inserted in, vertical scaffold member 52 ("receiving tube" as depicted in FIG. 5). Of course either may serve as the "insertion tube" or "receiving tube" as desired. Both scaffold support posts 22 and vertical scaffold member 52 may have one or more lock pin holes 502*a*/502*b*/504*a*/504*b*. Lock pins 506 may be inserted through corresponding lock pin holes 502*a*/504*a* and 502*b*/

504*b* to keep scaffold 50 removably attached to movable scaffolding base 10. Of course other approaches to maintaining the removable attachment are known to those of skill in the art, including simply the weight of scaffold 50 providing enough attachment through insertion of one tube into the other, overlapping and telescoping members, arms, tubes, tracks, channels, plates, and the like.

Scaffold 50 may be modified to further include tie down member 54 that is welded or secured in other known ways to the scaffold structure. Tie down member 54 is adapted to receive a lanyard (not shown) from a worker's safety harness (not shown) to provide protection against a fall from the scaffold 50.

Frame and Orientations

Frame 14, and any elements of movable scaffold base 10 that may extend outside of frame 14, may generally be rectangular and with a length of about 1.5-3 meters (sides 44*a* and 44*b*) and width of about 0.75-2 meters (front 40 and rear 42). The size and shape of frame 14 is a matter of choice and these dimensions are chosen to enable movable scaffold base 10 to most effectively be used in operation and receive removably attachable standard scaffolds. Frame 14, and indeed various other elements of movable scaffolding base 10 may be made of lightweight materials, such as metal or aluminum.

Frame 14 may define a horizontal plane 46 when movable scaffold base 10 is in position for operation (operation orientation) and receiving assembled scaffold 50.

Figure 3:
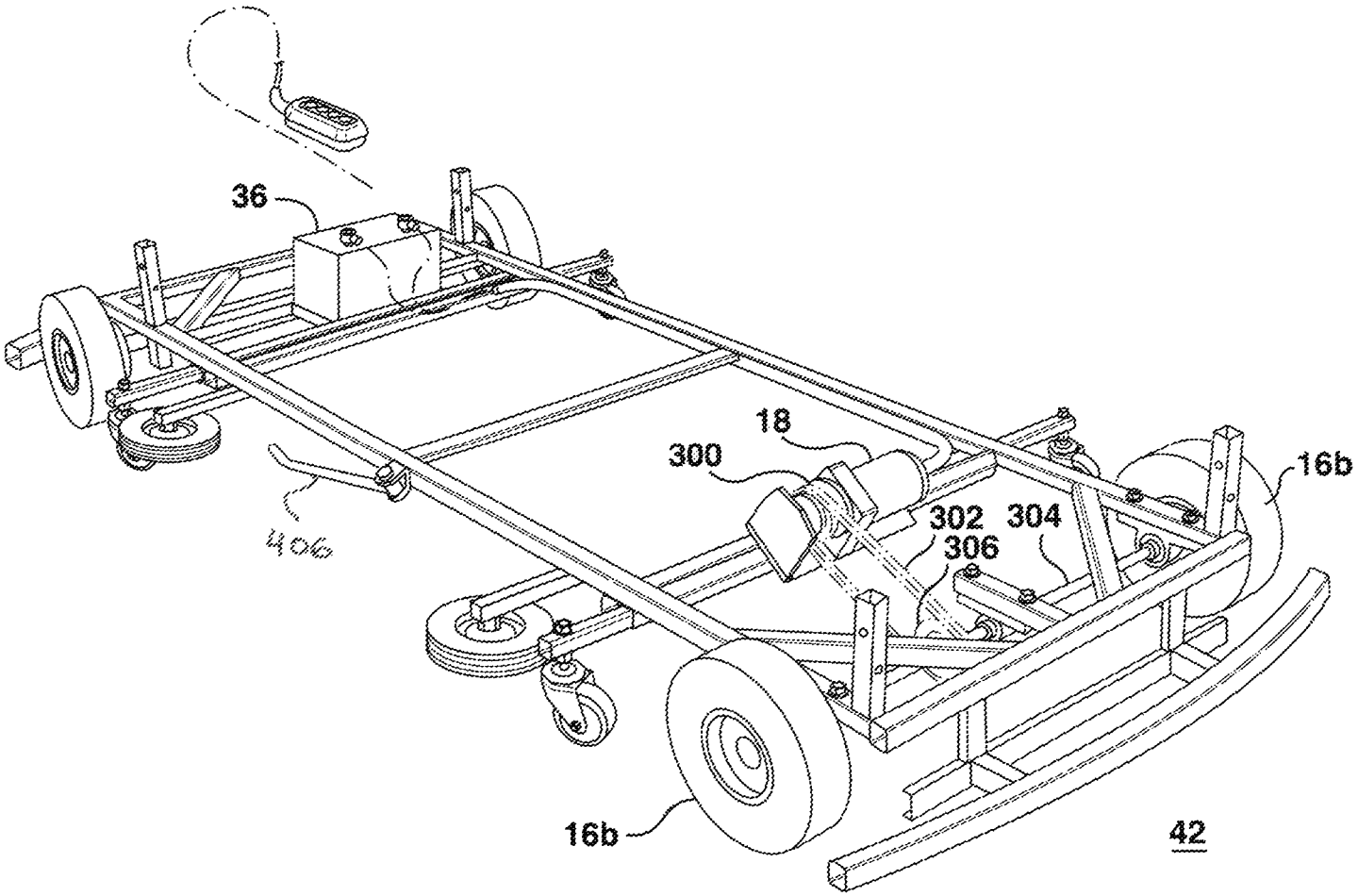
FIG. 3 is a perspective view of the base for the movable scaffold of FIG. 1 with additional details of the drivetrain, according to an embodiment of the invention.
Figure 4:
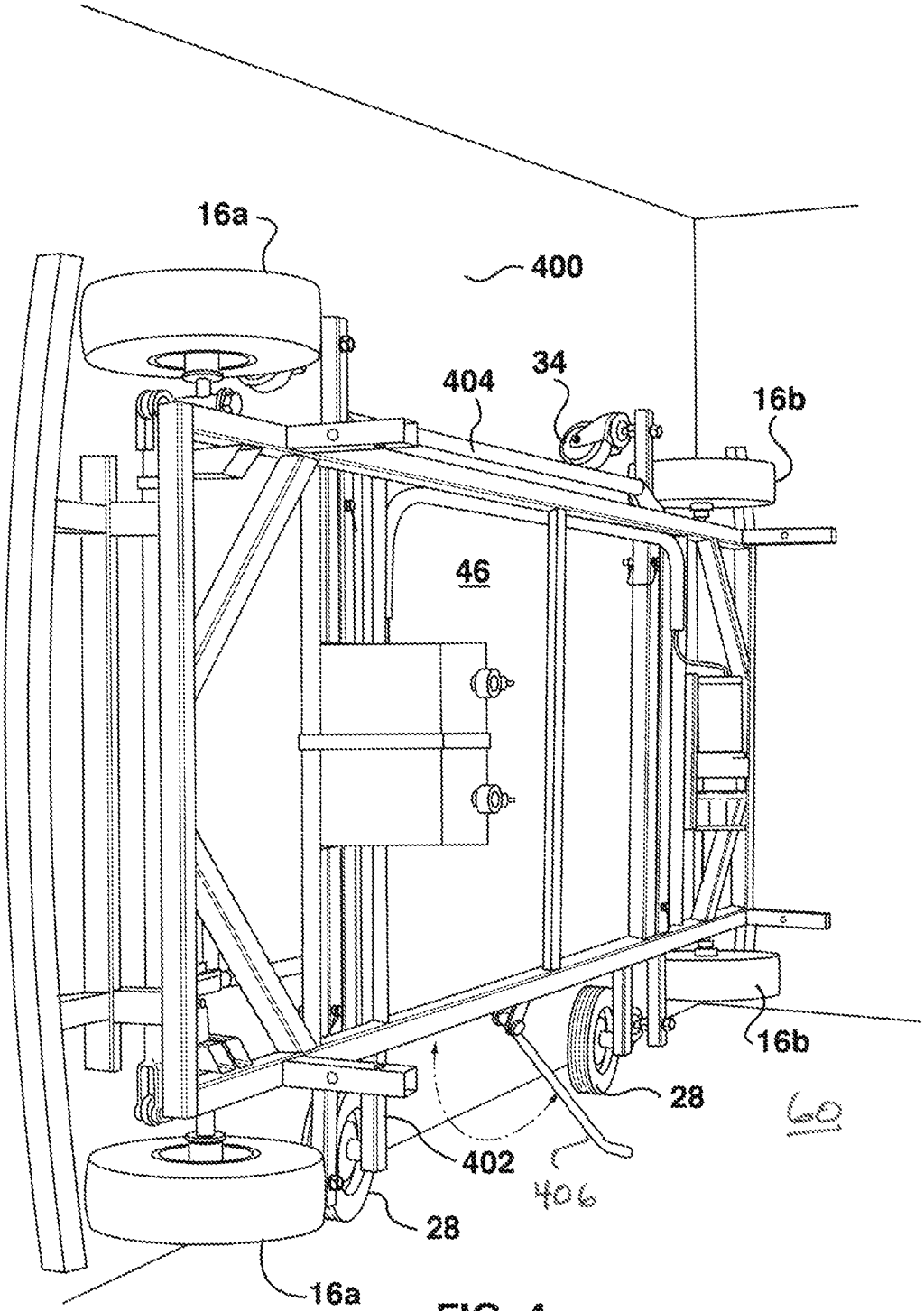
FIG. 4 is a perspective view of the base for the movable scaffold of FIG. 1 on its side to facilitate storage thereof, according to an embodiment of the invention.

Frame 14 may also be re-oriented by lifting it onto its side, as shown in FIG. 4, for ease of storage and transport. Grab bar 404 may be attached to frame 14 and facilitate movable scaffolding base 10 to be lifted. In such orientation (storage orientation) horizontal plane 46 may substantially be a vertical plane, and movable scaffolding base 10 may be able to fit through narrower spaces and be stored side by side. When in storage orientation movable scaffolding base 10 may rest on floor surface 60 on storage wheels 28 attached on storage posts 402 (which may make it easier for movable scaffolding base 10 to be 'wheeled around', or transported, while on its side) together with pivotable stand 406 that may be moved from a first position, adjacent to frame 14 as shown in FIG. 3, to a second position, extended from frame 14 to contact surface 60 as shown in FIG. 4 to support movable scaffolding base 10 in a vertical position. Movable scaffolding base 10 may alternatively rest on one more of wheels 16 (such as the side of one or more wheels 16), and/or may lean against wall surface 400 via parts of movable scaffolding base 10 such as wheels 16. Movable scaffolding base 10 may also be capable of standing in storage position without leaning on anything else. Of course storage wheels 28 may not be required; storage posts 402 and pivotable stand 406 may substantially support movable scaffolding base 10 or may have another attachment at the remote end of storage posts 402.

Stability—Outriggers and Tip Guards

Stability of movable scaffolding base 10 may be of particular importance, especially as the height of scaffolding 50 increases, the number of workers increases, ground surface 60 is less reliable or uniform, and the like.

Outriggers 24 may provide additional stability and safety to reduce the risk of movable scaffolding base 10 and scaffolding 50 from tipping or rotating in a particular direction. As shown in FIG. 1, outriggers 24 may be disposed and attached at various points along frame 14, such as two outriggers on each side of frame 14 (outriggers 24*a* and 24*b* preventing rotation of horizontal plane 46 towards side 44*a* and outriggers 24*c* and 24*d* preventing rotation of horizontal plane 46 towards side 44*b*). Outriggers 24 may extend outwards away from frame 14 horizontally (such as on side 44*a* or 44*b*), as described herein and may have outrigger wheels that extend downwards toward ground surface and may in fact rest on ground surface 60.

Outriggers 24 may comprise outrigger extending member 36 comprising extending member holes 32*a*/32*b* disposed along the length of extending member 36, and outrigger wheels 34 which may be removably attached to extending member 36 (such as via nuts and bolts attached to outrigger wheels 34 and extending through extending member holes 32 or via a lock pin). Outrigger wheels may be attached to extending member 36 at substantially any extending member hole 32 though in practice extending member hole 32 that is located most remote from frame 14 along extending member 36 may be used (a 'remote end'), to maximize the anti-tipping effect. Outrigger wheels may be rotatably attached to extending member 26 such that they are able to roll as movable scaffolding base 10 rolls, regardless of their initial orientation with respect to the direction of motion of movable scaffolding base 10 (such as caster wheels).

Figure 2:
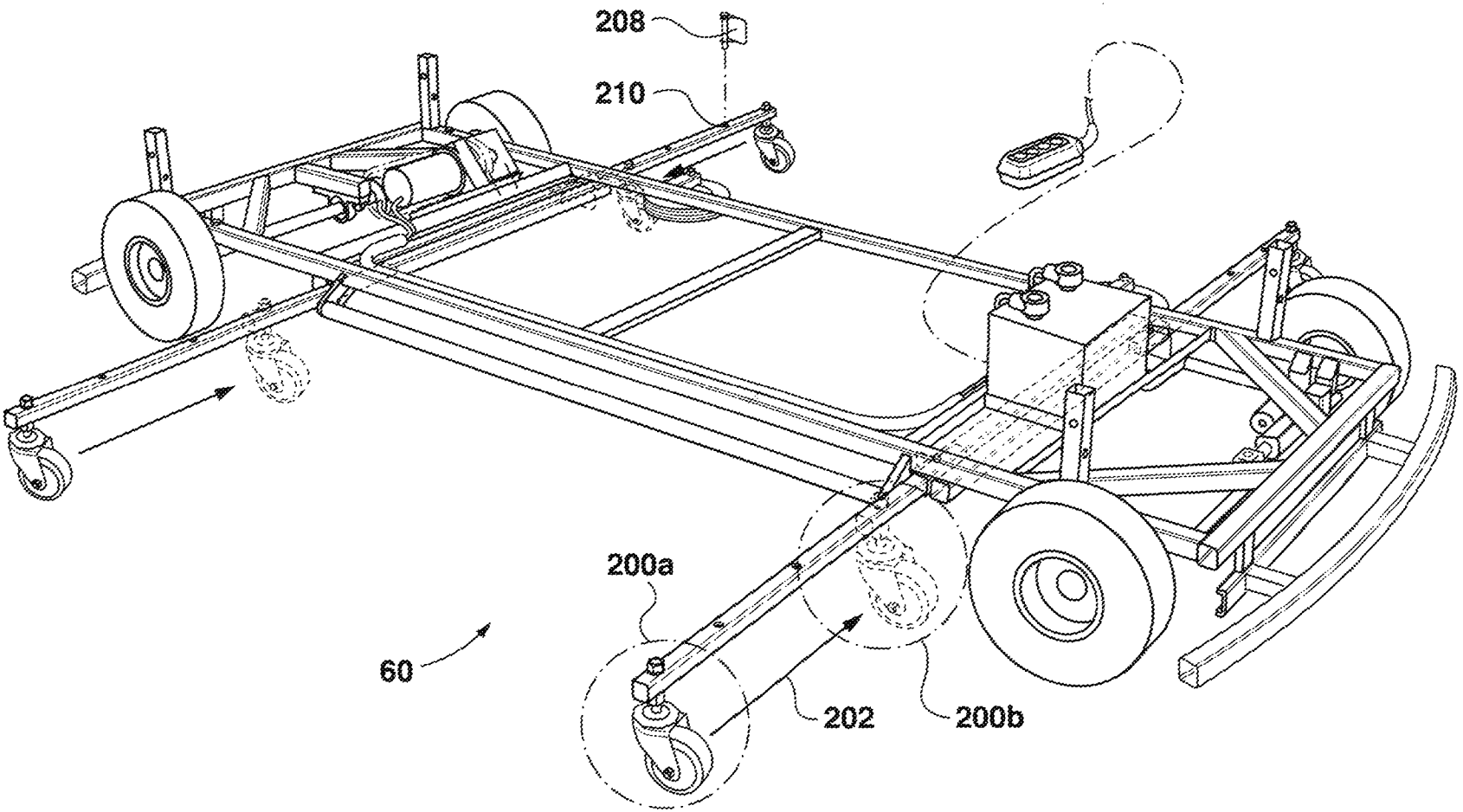
FIG. 2 is a perspective view of the base for the movable scaffold of FIG. 1 with the outriggers extended, according to an embodiment of the invention.

As shown in FIG. 2, outrigger sheaths 204 allow mating of outrigger 24 (via outrigger extending member 36) to enable outrigger 24 to telescope relative to sheath 204 and hence frame 14. Outrigger extending members 36 may couple with sheaths 204 of frame 14, in substantially a similar fashion to coupling of scaffold support posts 22 and vertical scaffold member 52. Outrigger pin 208 may be inserted into sheath holes 210 on outrigger sheaths 204 and into one or more extending member holes 32.

As shown in FIG. 2, outrigger 24 may be in an extended, or telescoped, position 200*a* and retracted position 200*b* by sliding, or telescoping, outrigger along path 202—essentially increasing the coupling of extending member 36 and sheath 204. Extended position 200*a* may be most useful during use of scaffold 50 on movable scaffolding base 10, while retracted position may be most useful when moving or storing movable scaffolding base 10. Of course any number of intermediate positions may be defined and used depending, for example, on the height of scaffold, and may be defined via placement of extending member holes 32 or may simply be created as outrigger is telescopically extended outwards or away from frame 14, such as out of sheath 204.

In addition to outriggers 24, movable scaffolding base may include one or more tip guards 26 to provide additional stability and safety to prevent movable scaffolding base 10 and scaffolding 50 from tipping or rotating in a particular direction. As shown in FIG. 1, tip guards 26 may be disposed and attached at various points along frame 14, such as one tip guard 26 on front 40 and rear 42 (tip guard 26 on front 40 preventing rotation of horizontal plane towards front 40 and tip guard 26 preventing rotation of horizontal plane 46 towards rear 42). Tip guards 26 may comprise a horizontal member connected to a point on frame 14 and may be connected to frame 14 by a member that extends away from frame 14, such as downward toward ground surface 60. Tip guards 26 may be aligned on frame 14 such that, if they extended all the way down to ground surface 60, at least a portion of tip guard 26 would be more remote from the center of frame 14 then the point of contact for the closest wheels (either front wheels 16*a* or rear wheels 16*b*). For example, tip guards 26 located at the rear may essentially be 'behind' the point of contact of rear wheels 16*b*, to assist in the prevention of tipping towards rear wheels 16*b*.

Drive and Steering

Movable scaffolding base 10 is both drivable and steerable.

FIG. 3 shows the primary drivetrain components. Motor 18 may be mounted substantially horizontally on frame 14 with its drive shaft (not shown) pointing along a width of frame 14 (such as parallel to rear 42). Rear wheels 16*b* may be attached to rear axle 304. Rear axle 304 may include a drive sprocket 306. Drive sprocket 306 may be driven by a chain or belt 302 by drive motor 18 and drive shaft (not shown), which motor sprocket 300 is attached to and turns. It is to be understood that other drivetrain designs are within the scope of the present invention.

The steering mechanism includes steering actuator 48 (that may be a linear actuator), actuator motor 54, and linkage bar 56. Actuator motor 54 is responsive to the controller and extends and retracts steering actuator to move linkage bar 56 upon receiving power, thus steering front wheels 16*a* right or left. Such steering mechanism, and other similar steering mechanisms that may alternatively be used, are substantially as known by those of skill in the art.

Power source 36 provides the power for the platform movable scaffolding base 10, including drive motor 18, steering actuator 48 and controller 38. Power source 36, in combination with controller 32, provide power to drive motor 18 and steering actuator, to effect the drive and steering. For added safety, wheels 16 are preferably locked to prevent movement when movable scaffolding base 10 is not driven by motor 18.

Controller

Controller 38 allows a user to control the drive and steering of movable scaffold base 10. Front-to-back movement or drive is accomplished by alternating and/or reversing the direction of rotation of the motor. Steering, or side-to-side motion of movable scaffold base 10, is accomplished by extending and retracting the steering actuator, as described herein. In one embodiment of controller 38, there are four buttons: forward, reverse, steer left and steer right. Each button provides a signal to affect the desired drive or steering response, with the forward button causing power from power source 36 to be provided to drive motor 18 (resulting in forward motion), the reverse button causing power from power source 36 to be provided to drive motor 18 to reverse its direction, the steer left button causing steering actuator 48 to extend and the steer right button causing steering actuator 48 to retract.

Controller 38 may be connected to power source 36 and, directly or indirectly, to drive motor 18 and actuator motor 54, via cord 58 (though controller 38 may communicate wirelessly with such components). Via cord 58, controller 38 may be placed or held on assembled scaffold 50 or on a ground surface 60 upon which movable scaffold rests.

Use

Movable scaffolding base 10 may initially be stored as shown in FIG. 4, and may be stored with other movable scaffolding bases 10 supported on stands 406 or leaning against wall surface and each other. A particular movable scaffolding base 10 may then be removed and put down on wheels 16 via grab bars 404. Movable scaffolding base 10 may then be moved into place for use, such as via controller 38, as described herein. Then scaffolding may be assembled thereon, creating an assembled scaffold, so that a worker may climb onto scaffold 50. Prior to climbing onto scaffold 50, a worker or other person may extend one or more outriggers to a desired extended and locked position so further assure movable scaffolding base 10 will not tip or rotate. Extending may comprise unlocking or unpinning outrigger 24 from sheaths 204 and telescopically extending them until the desired extended position, at which point locking pin 506 may be repined or reinserted—as such outriggers may be in various lockable and, to varying extents telescoped, positions. If a worker is working on wall surface 400 (such as painting a higher up portion of wall surface 400 then outriggers on the side opposite wall surface 400 may be extended only, as those on the same side as wall surface 400 need not be extended. Having painted a certain portion of wall surface 400 that is reachable from scaffold 50, a worker may desire to move movable scaffolding base 10 to another position so another part of wall surface 400 may be painted. This may be accomplished by driving and steering movable scaffolding base 10 via controller 38. Further painting may then be done. Of course, outriggers may be adjusted prior to moving movable scaffolding base 10 or may not need to be, for example depending on the exact nature of wall surface 400 (if curved outriggers may need to be retracted first, for example), ground surface 60 and other factors.

When the work is done with assembled scaffold 50 the worker may get down and move movable scaffolding base 10, then disassemble assembled scaffold 50, then further move movable scaffolding base 10 so that it can be lifted and put or placed on its side to be stored as in FIG. 4.

Various modifications and alternatives may be made to the invention. For example, shapes and dimensions of movable scaffolding base 10, and its subcomponents, may be changed. Outriggers 24 may be foldable or otherwise retractable, and may be done manually or automatically via some powered system. Outriggers may be adjusted to provide different levels of contact with ground surface 60 or to proactively descend or react to tilting or tipping that may occur or be occurring. Movable scaffolding base 10 may have other members, such as to provide additional structural support, as may be required for a particular application.

This concludes the description of the presently preferred embodiments of the invention. The foregoing description has been presented for the purpose of illustration and is not intended to be exhaustive or to limit the invention to the precise form disclosed. It is intended the scope of the invention be limited not by this description but by the claims that follow.

What is claimed is:

1. A movable scaffolding base for moving a scaffold along a ground surface, the movable scaffolding base comprising:

a rectangular frame having a front, a rear and two opposing sides with respective front, rear and side members that define a horizontal plane extending along an elongate axis;

a plurality of support posts extending upwardly from said frame and adapted for removably receiving and supporting corresponding upwardly extending scaffold members;

a drive motor disposed on said frame;

a pair of front wheels extending downwardly from said frame proximate to said front for engaging the ground surface and a pair of rear wheels extending downwardly from said frame proximate to said rear for engaging the ground surface, at least one of said pair of front wheels and said pair of rear wheels being driven by said drive motor;

a control system for controlling said drive motor;

a plurality of outriggers that are each adapted to slidably and lockably extend outwardly from corresponding outrigger sheaths disposed on at least one of said opposing sides of said frame to engage the ground surface outwardly from said frame and prevent the frame from tipping toward said outriggers;

a front tip guard connected directly to said front member of said frame forward of said front wheels and a rear tip guard connected directly to said rear member of said frame rearward of said rear wheels, said front tip guard and said rear tip guard each comprising a beam member extending across and generally directly below and parallel to respective said front and said rear members of said frame at a location between said frame and the ground surface so that the respective beam member engages the ground surface if said frame tips beyond a desired point toward said respective front and rear of said frame; and a front bumper located at said front of said frame forward of said front wheels and said front tip guard and a rear bumper located at said rear of said frame rearward of said rear wheels and said rear tip guard, said front bumper and said rear bumper each extending respectively across said front and said rear of said frame sufficiently to respectively cover said front wheels and said rear wheels, wherein said front bumper is mounted directly to said beam member that defines said front tip guard and said rear bumper is mounted directly to said beam member that defines said rear tip guard.

2. The movable scaffolding base according to claim 1 wherein each of said plurality of outriggers telescopically extends outwards from said corresponding outrigger sheaths.

3. The movable scaffolding base according to claim 2 wherein each of said plurality of outriggers is lockable in one of a plurality of telescoped positions.

4. The movable scaffolding base according to claim 1 wherein two of said outriggers extend outwards from a first of said two opposing sides of the frame and two of said outriggers extend outwards from a second of said two opposing sides of the frame.

5. The movable scaffolding base according to claim 1 wherein each of said plurality of outriggers comprises an extending member and an outrigger wheel, the outrigger wheel being removably affixed to said extending member at a remote end of the extending member.

6. The movable scaffolding base according to claim 1 further comprising at least one storage leg, attached to one of said opposing sides of the frame, that allows the base to be stored on its side.

7. The movable scaffolding base according to claim 6 wherein the at least one storage leg further comprises at least one storage wheel attached thereto that allows the base to be rolled when the base is on its side.

8. The movable scaffolding base according to claim 1 further comprising a pivotable stand, attached to the frame, that allows the base to be stored on its side.

9. The movable scaffolding base according to claim 1 further comprising at least one upwardly extending scaffold member that is adapted to be removably supported on at least some of said plurality of support posts.

10. The movable scaffolding base according to claim 9, wherein said at least one upwardly extending scaffold member includes a tie down member for receiving a lanyard for a safety harness.

* * * * *